US008242969B2

(12) United States Patent
Lutman et al.

(10) Patent No.: US 8,242,969 B2
(45) Date of Patent: Aug. 14, 2012

(54) CONNECTION FOR ANTENNAS OPERATING ABOVE A GROUND PLANE

(75) Inventors: Thomas Goss Lutman, Cuyahoga Falls, OH (US); Stephen V. Saliga, Akron, OH (US)

(73) Assignee: Cisco Technology, Inc., San Jose, CA (US)

( * ) Notice: Subject to any disclaimer, the term of this patent is extended or adjusted under 35 U.S.C. 154(b) by 553 days.

(21) Appl. No.: 12/437,936

(22) Filed: May 8, 2009

(65) Prior Publication Data

US 2010/0283710 A1 Nov. 11, 2010

(51) Int. Cl.
*H01Q 1/50* (2006.01)

(52) U.S. Cl. ..... 343/906; 343/700 MS

(58) Field of Classification Search ..... 343/700, 343/829, 846, 906; 29/428, 600
See application file for complete search history.

(56) References Cited

U.S. PATENT DOCUMENTS

| | | | | |
|---|---|---|---|---|
| 4,370,657 | A * | 1/1983 | Kaloi | 343/700 MS |
| 5,025,264 | A | 6/1991 | Stafford | |
| 5,307,075 | A * | 4/1994 | Huynh | 343/700 MS |
| 5,408,241 | A * | 4/1995 | Shattuck et al. | 343/700 MS |
| 6,218,991 | B1 * | 4/2001 | Sanad | 343/700 MS |
| 6,400,321 | B1 | 6/2002 | Fenwick et al. | |
| 6,795,023 | B2 * | 9/2004 | Chen | 343/700 MS |
| 6,903,687 | B1 | 6/2005 | Fink et al. | |

* cited by examiner

*Primary Examiner* — Tho G Phan
(74) *Attorney, Agent, or Firm* — Brinks Hofer Gilson & Lione

(57) ABSTRACT

An antenna system is provided. The antenna system includes a ground plane, an antenna, a feed cable, a cable connector, and an antenna connector. The ground plane has a first ground side and a second ground side. The antenna operates on the first ground side of the ground plane. The feed cable has a center conductor that is configured to transmit signals to and receive signals from the antenna. The cable connector couples the feed cable with the second ground side of the ground plane. The center conductor of the feed cable is electrically isolated from the ground plane and electrically coupled with the antenna connector. The antenna connector electrically couples the center conductor with the antenna. The antenna connector is connected to the center conductor and the feed cable is substantially parallel to the ground plane from the antenna connector to the cable connector.

22 Claims, 11 Drawing Sheets

CONNECTION FOR ANTENNAS OPERATING ABOVE A GROUND PLANE

FIELD OF TECHNOLOGY

The present embodiments relate to a connection for antennas that operate above a ground plane. In particular, the present embodiments relate to an antenna connector that electrically couples a feed cable with an antenna operating above a ground plane.

BACKGROUND

Antennas may be used to transmit and receive signals. An antenna in a network, such as a wireless local area network, may operate above a ground plane. The signals transmitted to or received from the antenna may be transmitted to the antenna from a feed cable. Support systems are used to support the antenna. Separately, a crimp sleeve is used to connect the antenna to the feed cable. The feed cable is placed in the crimp sleeve. Since the crimp sleeve is perpendicular to the ground place, the feed cable is also disposed perpendicular to the ground plane. The crimp sleeve and the minimum bend radius of the feed cable prevent antennas from being used in some products.

DETAILED DESCRIPTION

The present embodiments relate to a connection for antennas that operate above a ground plane. The connection may include an antenna connector that electrically couples a feed cable with an antenna that operates above a ground plane. As used herein, the phrase "above a ground plane" may include on a side of the ground plane that is opposite the feed cable, whether directed up, down, or another direction. The antenna connector may include a feed probe and a conductor tab coupled with the feed probe. The feed probe may be electrically coupled with the antenna and the conductor tab may be electrically coupled with feed cable. The feed cable is arranged substantially parallel to the ground plane. In alternative embodiments, the antenna may operate on the same side as the feed cable.

In one aspect, an antenna system includes a ground plane, an antenna, a feed cable, a cable connector, and an antenna connector. The ground plane has a first ground side and a second ground side. The antenna operates on the first ground side of the ground plane. The feed cable has a center conductor that feeds the antenna. The cable connector couples the feed cable with the second ground side. The feed cable may be electrically isolated from the ground plane. The antenna connector electrically couples the center conductor with the antenna. The antenna connector is connected to the center conductor. The feed cable may be substantially parallel to the ground plane from the antenna connector to the cable connector.

In a second aspect, a connector includes a feed probe that extends through a ground plane and into an antenna and a metal tab. The metal tab extends from the feed probe in a direction parallel to the ground plane and is operable to electrically couple a feed cable with the feed probe. The feed cable extends perpendicular to the feed probe.

In a third aspect, a method for attaching an antenna to a feed cable is provided. The method includes inserting a feed probe into an opening in a metal tab, an opening in the ground plane, and an opening in the antenna; electrically coupling the feed probe with the antenna and the metal tab; and connecting a conductor of the feed cable with the conductor tab using a conductor connection. The feed cable may extend parallel to or substantially parallel to the ground plane.

Figure 1:
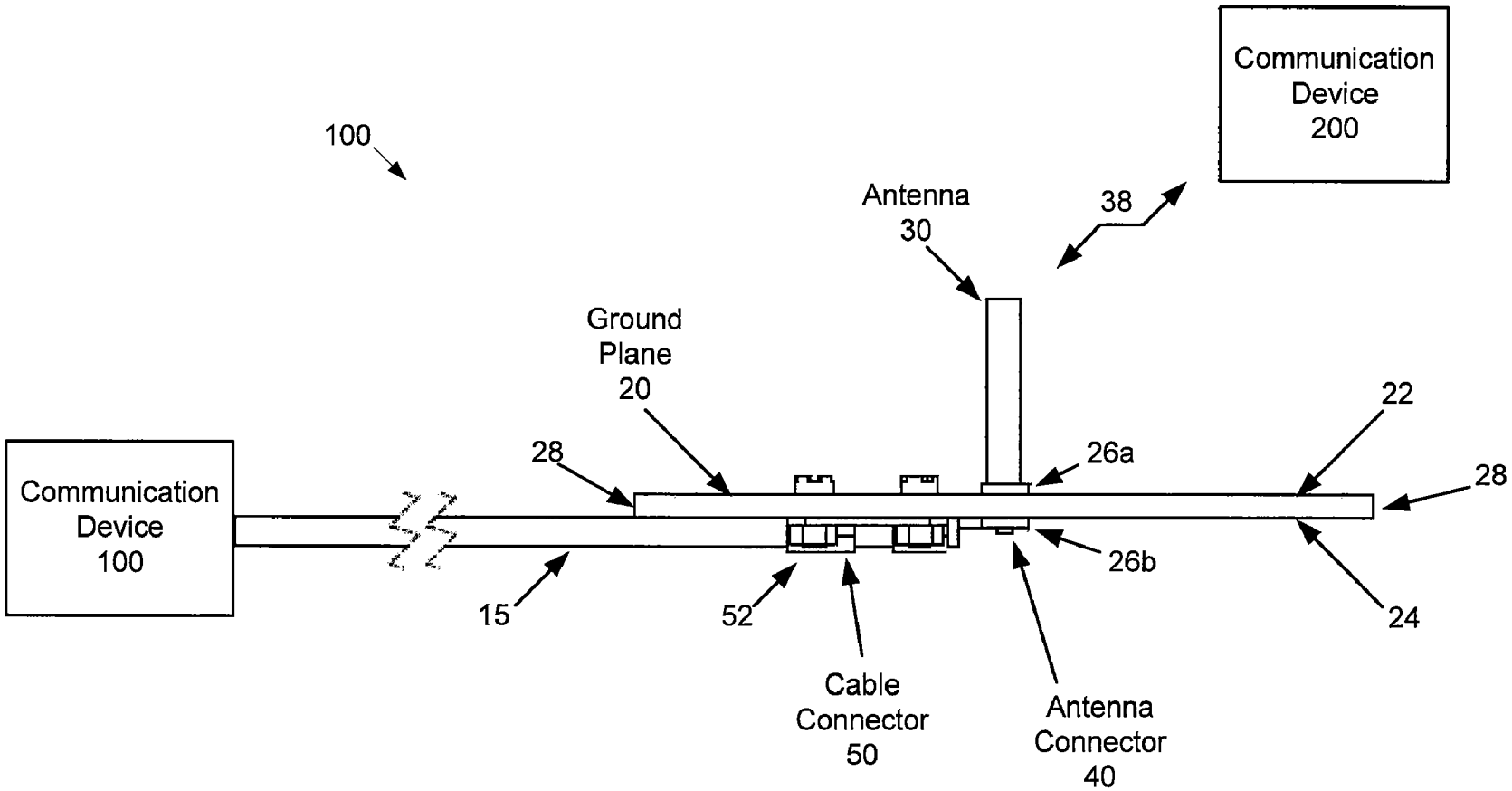
FIG. 1 illustrates one embodiment of an antenna system.

FIG. 1 shows an antenna system 100. The antenna system 100 includes a feed cable 15, a ground plane 20, an antenna 30, an antenna connector 40, and a cable connector 50. The antenna 30 may be disposed on and operate on a first ground side 22 of the ground plane 20. The feed cable 50 may be disposed on and operate on a second ground side 24 of the ground plane 20. The first ground side 22 may be opposite the second ground side 24. The antenna connector 40 may be sized, shaped, and positioned to electrically couple the antenna 30 with the feed cable 50. All or some of the feed cable 50, for example, from the antenna connector 40 to a ground plane edge 28, is parallel or substantially parallel to the ground plane 20. "Substantially" accounts for deviations to go over obstructions such as solder bumps or circuit components. The system 100 may include additional, different, or fewer components. For example, the antenna system 100 may not include the cable connector 50.

As used herein, the phrases "coupled with," "coupling with," and "couple(s) . . . with" may include a direct connection to or an indirect connection through one or more intermediate components. Such intermediate components may include both hardware and software based components. As used herein, the term "feed" may include provide or supply materials and/or signals. For example, a feed cable 15 coupled with the antenna 30 may be a cable that provides signals to the antenna 30. Providing signals may include transmitting signals to or receiving signals from.

The antenna system 100 may be used for communicating in a network, such as a wireless network, telecommunication network, personal area network (PAN), local area network (LAN), campus area network (CAN), metropolitan area network (MAN), or wide area network (WAN). The network may be a wired network, wireless network, or a combination thereof. For example, the antenna system 100 may be used for communication between a first communication device 100 and a second communication device 200. The first communication device 100 may transmit signals to or receive signals from the feed cable 15. The antenna connector 40 couples the feed cable 15 with the antenna 30. The antenna 30 may transmit signals to or receive signals from the feed cable 15.

The antenna 30 may wirelessly transmit signals to or receive signals from the second communication device 200. The first communication device 100 and second communication device 100 may be routers, servers, personal computers, access points (e.g., built to be used with 802.11a, b, g, or n protocols, some combination of those protocols, or other protocols), laptops, point-of-sale terminals, portable printers, bar-code scanners, WiFi client devices, other devices for communicating, or a combination thereof.

Figure 2:
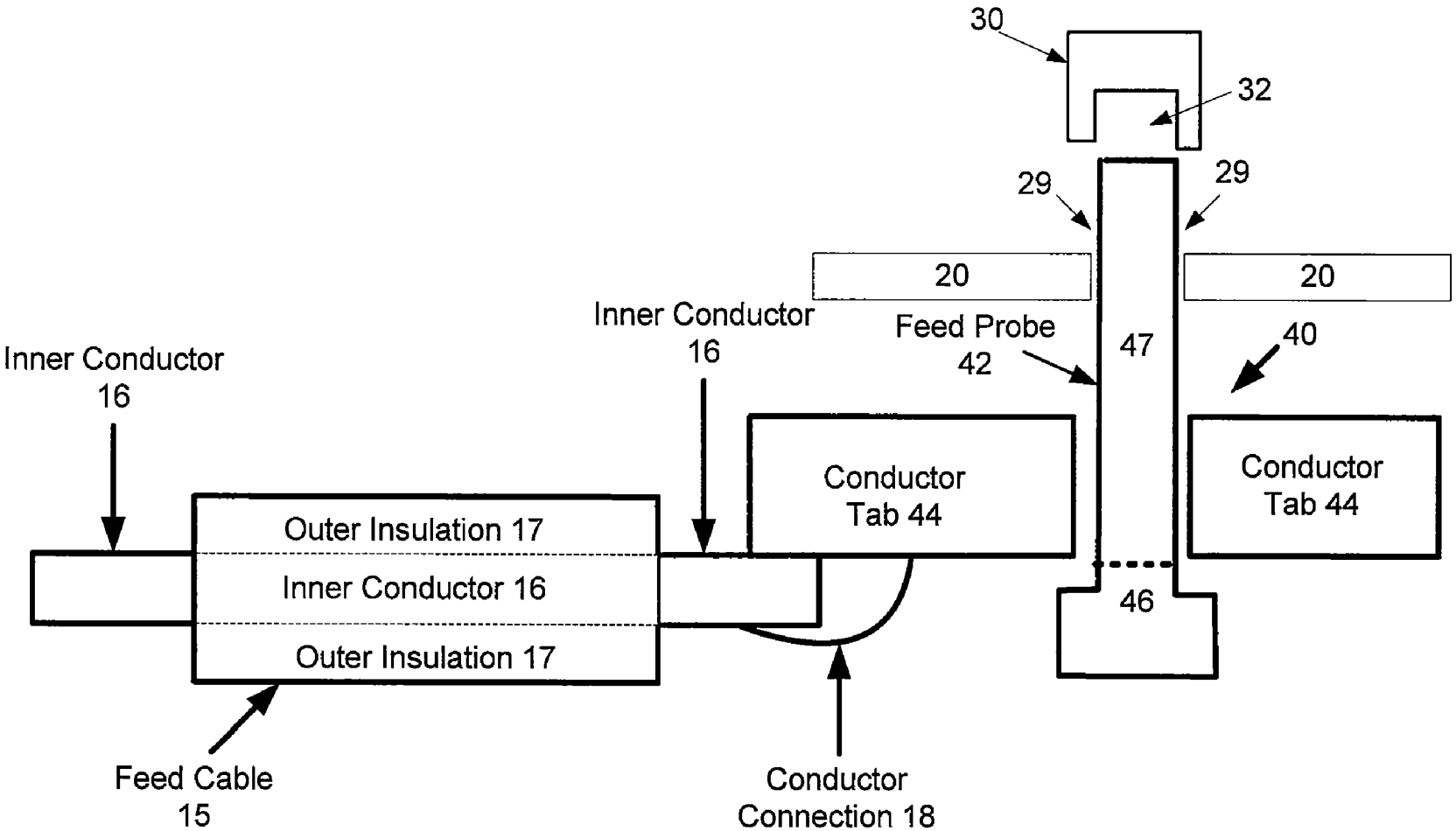
FIG. 2 illustrates one embodiment of a feed cable and an antenna connector.

The feed cable 15 may be a transmission line, network segment, communication wire, a wire that transmits signals to and from the antenna connector 40, coaxial cable, or other communication line that may be used to drive the antenna 30. As shown in FIG. 2, the feed cable 15 may include an inner conductor 16 and an outer insulation layer 17. The outer insulation layer 17 may be disposed around and insulate the inner conductor 16. The inner conductor 16 may be used to transmit signals between the communication device 100 and the antenna connector 40.

In one embodiment, the feed cable 15 may be a coaxial cable having a silver plated inner conductor 16 and an outer insulation layer 17 that is made of plastic. The outer insulation layer 17 may surround all, some, or none of the silver plated inner conductor 16. For example, an end portion of the inner conductor 16 may be exposed (e.g., not covered by the outer insulation layer 17). The exposed portion of the inner conductor 16 may be coupled with the communication device 100 and/or antenna connector 40. Other layers may be provided in the feed cable 15. A dielectric insulator and/or a metallic shield may be provided.

Referring back to FIG. 1, the ground plane 20 may include a first ground side 22, a second ground side 24, and a ground plane edge 28. The first ground side 22 may be opposite the second ground side 24. The ground plane edge 28 may extend around an edge of the ground plane 20. The ground plane edge 28 may define a border of the ground plane 20. In alternative embodiments, the ground plane 20 may include additional, different, or fewer components. For example, as will be discussed in more detail below, the ground plane 20 may include one or more openings (e.g., holes, vias, or gaps) 29 for coupling the cable connector 50 to the ground plane 20 or for allowing the antenna connector 40 to pass through the ground plane 20.

Figure 3:
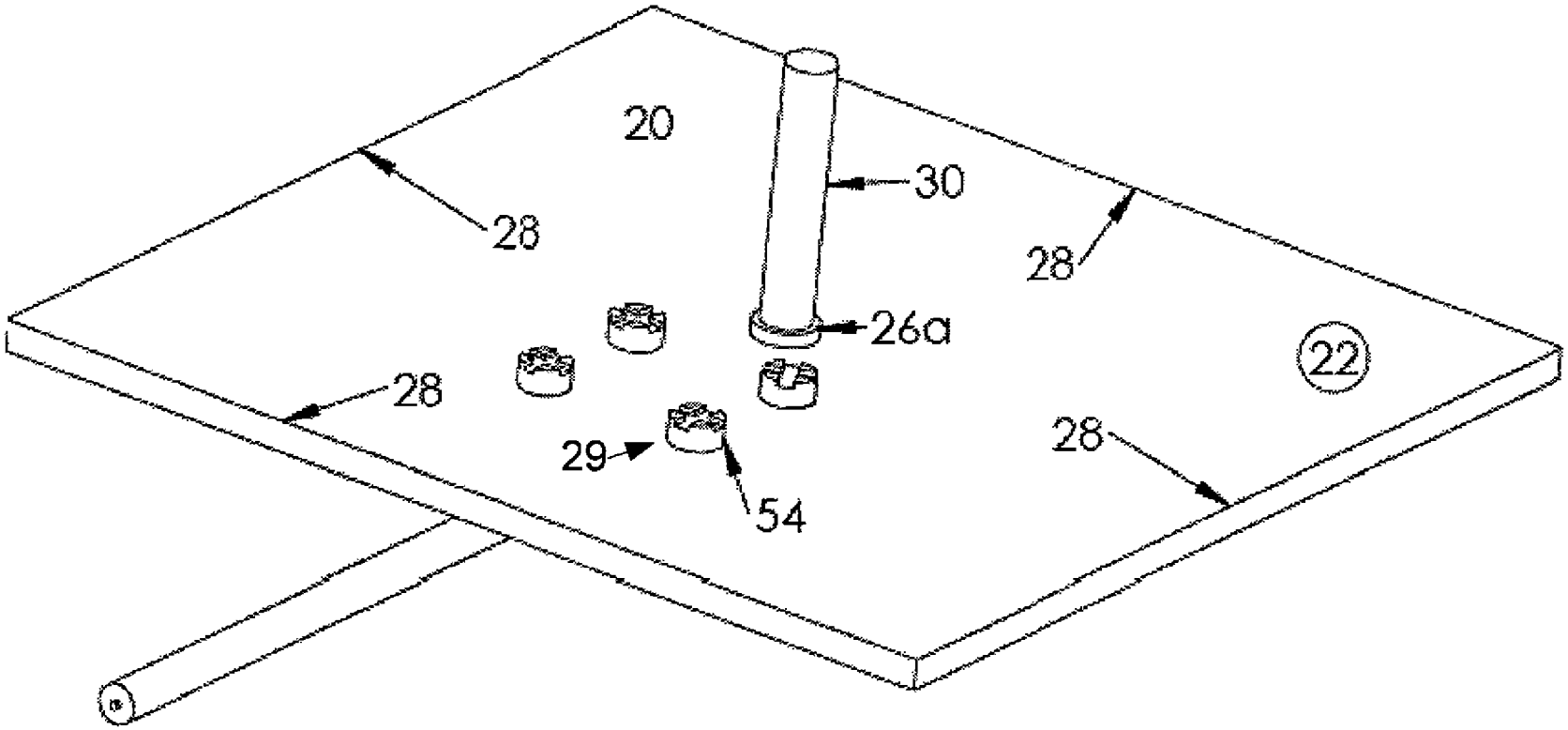
FIG. 3 illustrates a top view of one embodiment of an antenna system.
Figure 4:
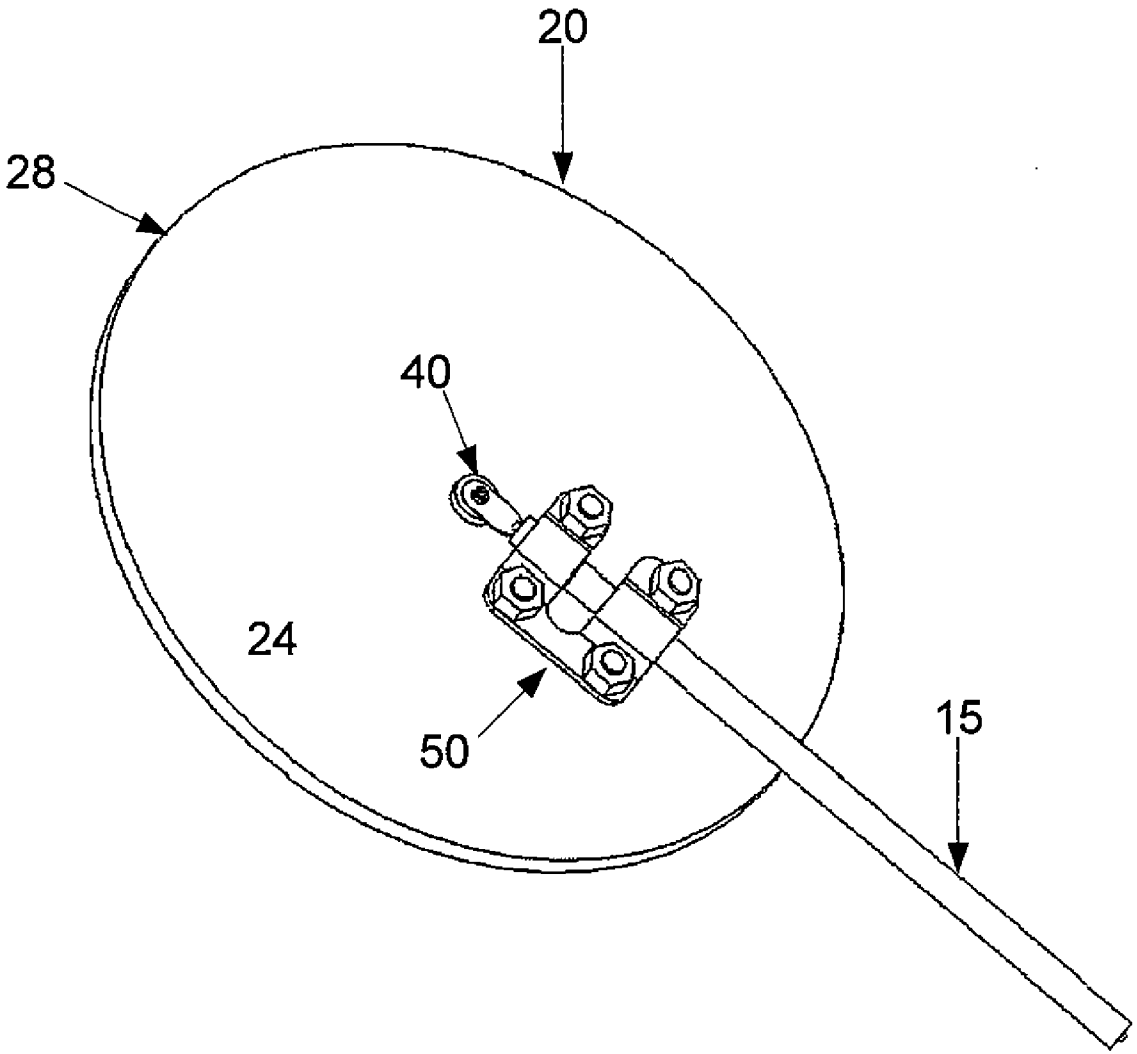
FIG. 4 illustrates a bottom view of one embodiment of an antenna system.

The ground plane 20 may be a flat, smooth, rough, curved, irregular, or rounded surface that is shaped and structured to limit the radiation of the antenna 30 in at least one direction of radiation. The ground plane 20 may be an electrically conductive surface. The ground plane 20 may be a flat, grounded piece of metal that extends a minimum of one wavelength in each direction from the antenna 30. The ground plane 20 may form a reflector or director for the antenna 30. The ground plane 20 may be sized and shaped to limit the radiation of the antenna 30 in a certain direction, for example, downward, sideward, or upward. As a result, the ground plane 20 may be sized and shaped based on the size and/or type of antenna 30 being used. In one example, an antenna 30 may operate on a first ground plane side 22 of a four (4) inch ground plane 20. The ground plane may be larger or smaller depending on the size and type of antenna 30 used. The shape of the ground plane 20 is not limited. Any shape may be used. FIGS. 3 and 4 show exemplary shapes of the ground plane 20. The ground plane edge 28 may define a square ground plane 20, as shown in FIG. 3. However, as shown in FIG. 4, the ground plane edge 28 may define a circular ground plane 20. The ground plane edge 28 may define other symmetrical or non-symmetrical shapes.

Figure 5:
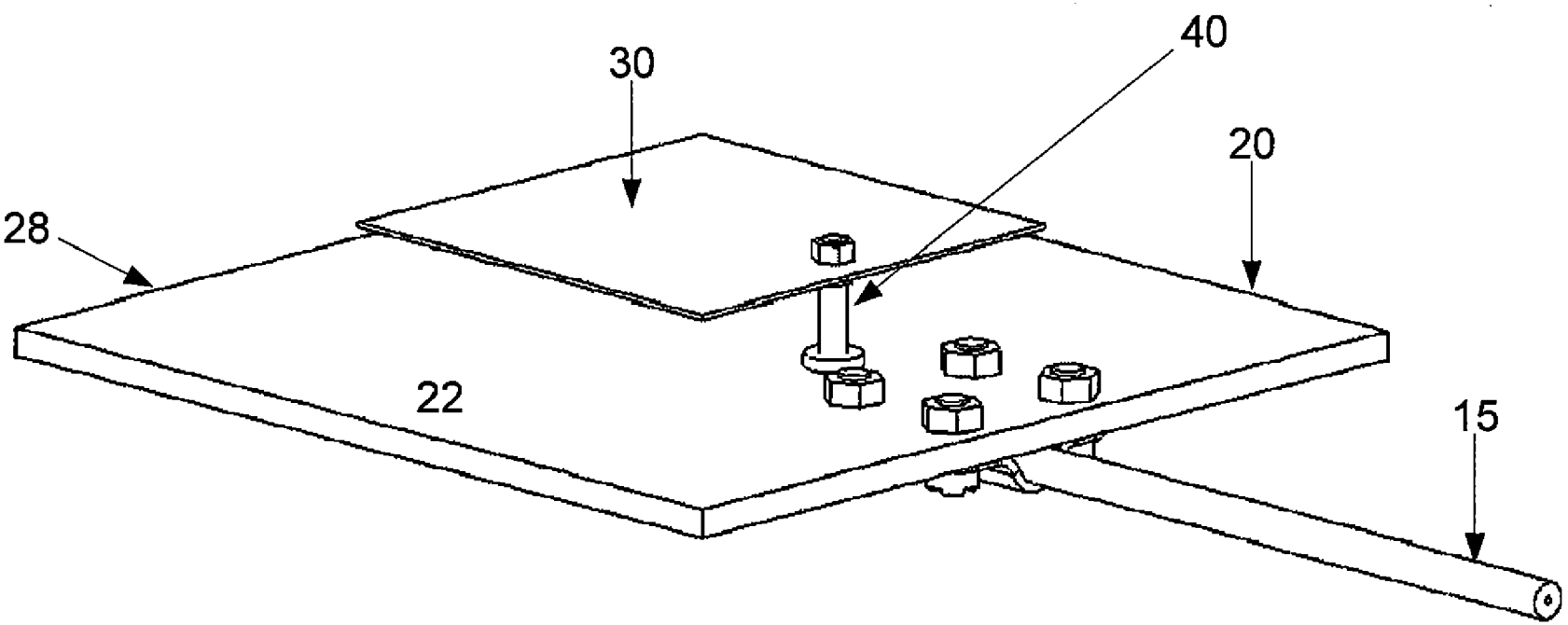
FIG. 5 illustrates a top view of another embodiment of an antenna system.
Figure 6:
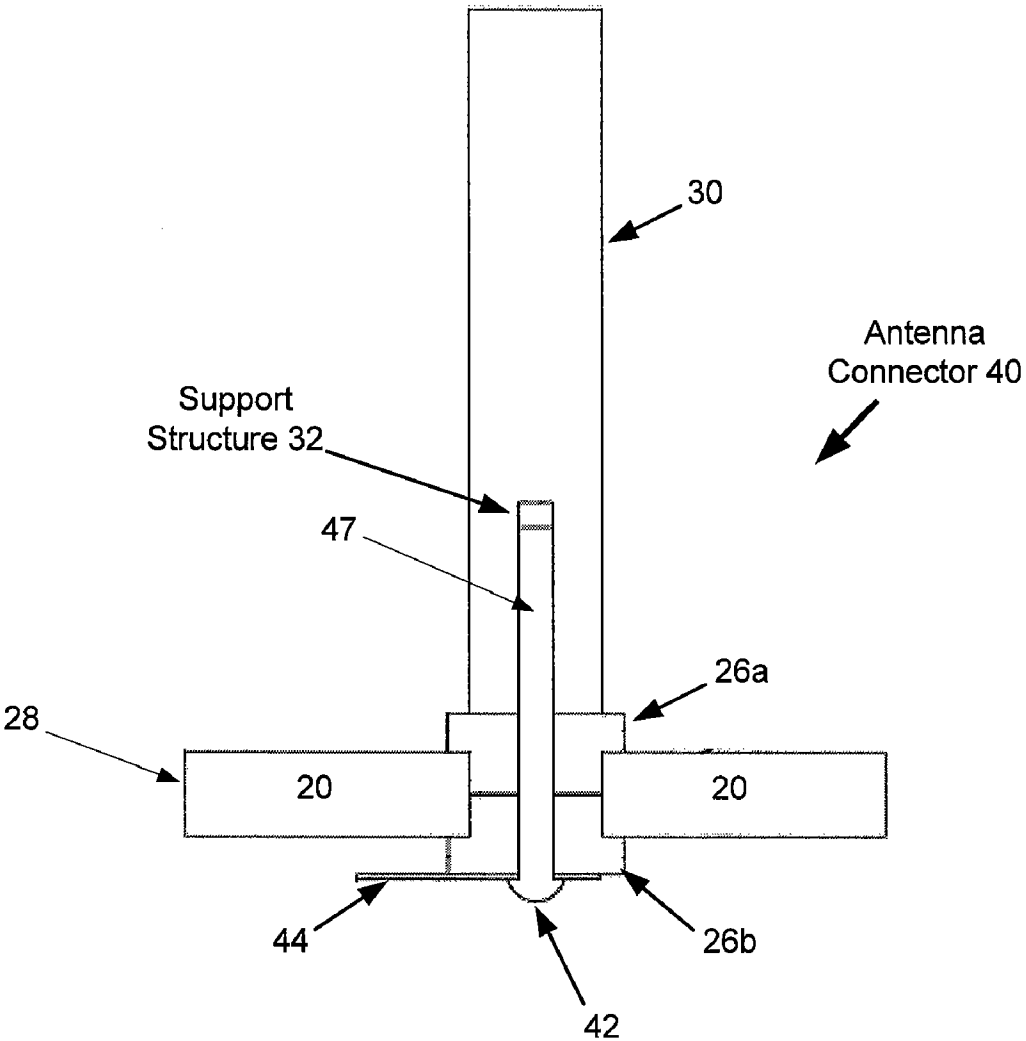
FIG. 6 illustrates one embodiment of an antenna connector and an antenna.
Figure 7:
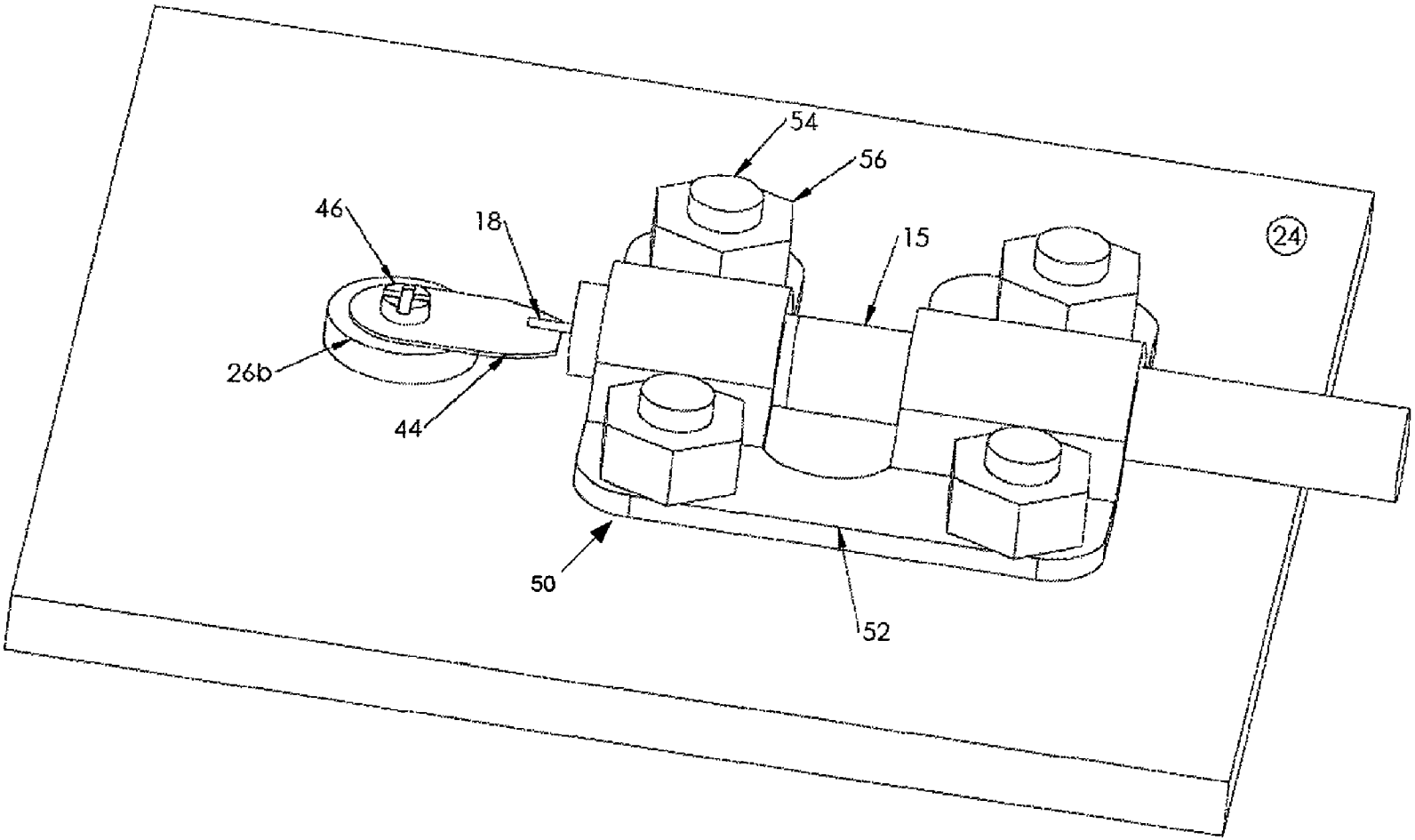
FIG. 7 illustrates a bottom view of one embodiment of an antenna system.

The antenna 30 may be a monopole antenna, a dipole antenna, a patch antenna, a probe fed antenna, an end-fed omni directional antenna or other antenna that operates above a ground plane 20. FIGS. 5-6 illustrate different types of antennas 30. FIG. 5 illustrates one example of a patch antenna. Greater or lesser separation between the ground plane 20 and patch antenna 30 may be used. FIG. 6 illustrates one example of a monopole antenna.

Referring back to FIG. 1, the antenna 30 may include a transducer that is operable to transmit and receive signals. For example, the antenna 30 may receive a signal from the feed cable 50. The signal may be wirelessly transmitted 38 to the communication device 200. In another example, the antenna 30 may wirelessly receive 38 a signal from the communication device 200 and transmit the received signal to the feed cable 15 via the antenna connector 40. The antenna 30 may be made of or plated with brass or another metal that is compatible with the antenna connector 40.

As shown in FIG. 6, the antenna 30 may include a support structure 32. The support structure 32 may be a support hole, opening, cavity, finger, snap, clip, latch, connector, other device that attaches or connects the antenna 30 to an antenna connector 40 (e.g., as discussed below, the feed probe 42), or a combination thereof. The support structure 32 may be sized, shaped, structured, or a combination thereof to receive or engage with the antenna connector 40. As used herein, the phrase "engage with" includes brought together and interlocked. In the embodiment of FIG. 5, the support structure 32 is a support hole through the patch antenna 30. The feed probe 42 may be inserted through the support hole. A locking mechanism, such as one or more nuts, may be provided on one or both sides of the patch antenna 30 to support the patch antenna 30. In the embodiment of FIG. 6, the support structure 32 is a cavity that is sized and shaped to allow a feed probe 42 of the antenna connector 40 to be inserted into the cavity. The cavity in the antenna 30 is used to structurally support the antenna 30. No other connections, crimp sleeves, or support devices may be needed to support the antenna 30. Alternatively, or additionally, all or some of the support structure 32 may be threaded to engage with a threading of the feed probe 42.

FIG. 2 illustrates one embodiment of an antenna connector 40. The antenna connector 40 may include a feed probe 42 and a conductor tab 44. Additional, different, or fewer components may be provided. The antenna connector 40 may be a feed structure that electrically couples the inner conductor 16 of the feed cable 15 with the antenna 30. The antenna connector 40 is structured and connected so the feed cable 15 may extend in a direction that is parallel or substantially parallel to the ground plane 20. Additionally, the antenna connector 40 may mechanically support the antenna 30.

The feed probe 42 may be a probe, pin, screw, bolt, or other electrical conductor that extends from the first ground side 22 to the second ground side 24. In one embodiment, the feed probe 42 is a screw that includes a screw head 46 and a screw shaft 47. The screw head 46 may be disposed on the second ground side 24 and electrically coupled with the conductor tab 44. The screw shaft 47 may extend from the second ground side 24 to the first ground side 22 through an opening 29 in the ground plane 20. The screw shaft 47 may extend into or through and be electrically coupled with the support structure 32 of the antenna 30. The screw shaft 47 may include threading that may engage with (e.g., be threaded into) threading of the support structure 32.

One benefit of the feed probe 42 extending into and/or engaging with the support cavity in the antenna 30 is that the antenna 30 may be mechanically and structurally supported by the feed probe 42. Accordingly, the antenna 30 may be supported without complex and/or additional connectors. Since the feed probe 42 is electrically coupled with the antenna 30, the feed probe 42 may be used to transmit signals to and receive signals from the antenna 30, as well as structurally supporting the antenna 30.

The conductor tab 44 may be a solder tab, metal tab, washer, clip, snap, latch, or other tab that may be used to electrically couple the inner conductor 16 with the feed probe 42. The conductor tab 44 may be a piece of metal that electrically couples the inner conductor 16 of the feed cable 15 with the feed probe 42. The conductor tab 44 may have an opening that is sized to allow the screw shaft 47 to extend through the opening; however, the opening may be small enough to prevent the screw head 46 from passing through the opening.

The conductor tab 44 may extend toward an edge 28 of the ground plane 20. The conductor tab 44 may extend toward the feed cable 15 and/or the cable connector 50. The conductor tab 44 may be sized to receive the inner conductor 16 of the feed cable 15. As used herein, the phrase "sized to receive" includes sized to be connected or attached to the inner conductor 16. A conductor connection 18 may be used to couple the inner conductor 16 with the conductor tab 44. The conductor connection 18 may be solder, a clip (e.g., an alligator clip), a band, tape, conducting glue, connector, insulation, other electrical conductor, other isolator, or a combination thereof. For example, the conductor tab 44 may be sized such that the inner conductor 16 may be placed above, below, or to the side of the conductor tab 44 and soldered to the conductor tab 44, as shown in FIG. 2. The inner conductor 16 does not bend, does not bend at a right angle, or has limited bending while connected to the conductor tab 44. In another example, the conductor connection 18 includes solder and insulation tape. In this example, the conductor tab 44 is soldered to the inner conductor 16 and insulation tape is wrapped around the inner conductor 16, conductor connection 18, and conductor tab 44. The insulation tape may be used to electrically isolate the inner conductor 16, conductor connection 18, and conductor tab 44 from the ground plane 20.

Figure 8:
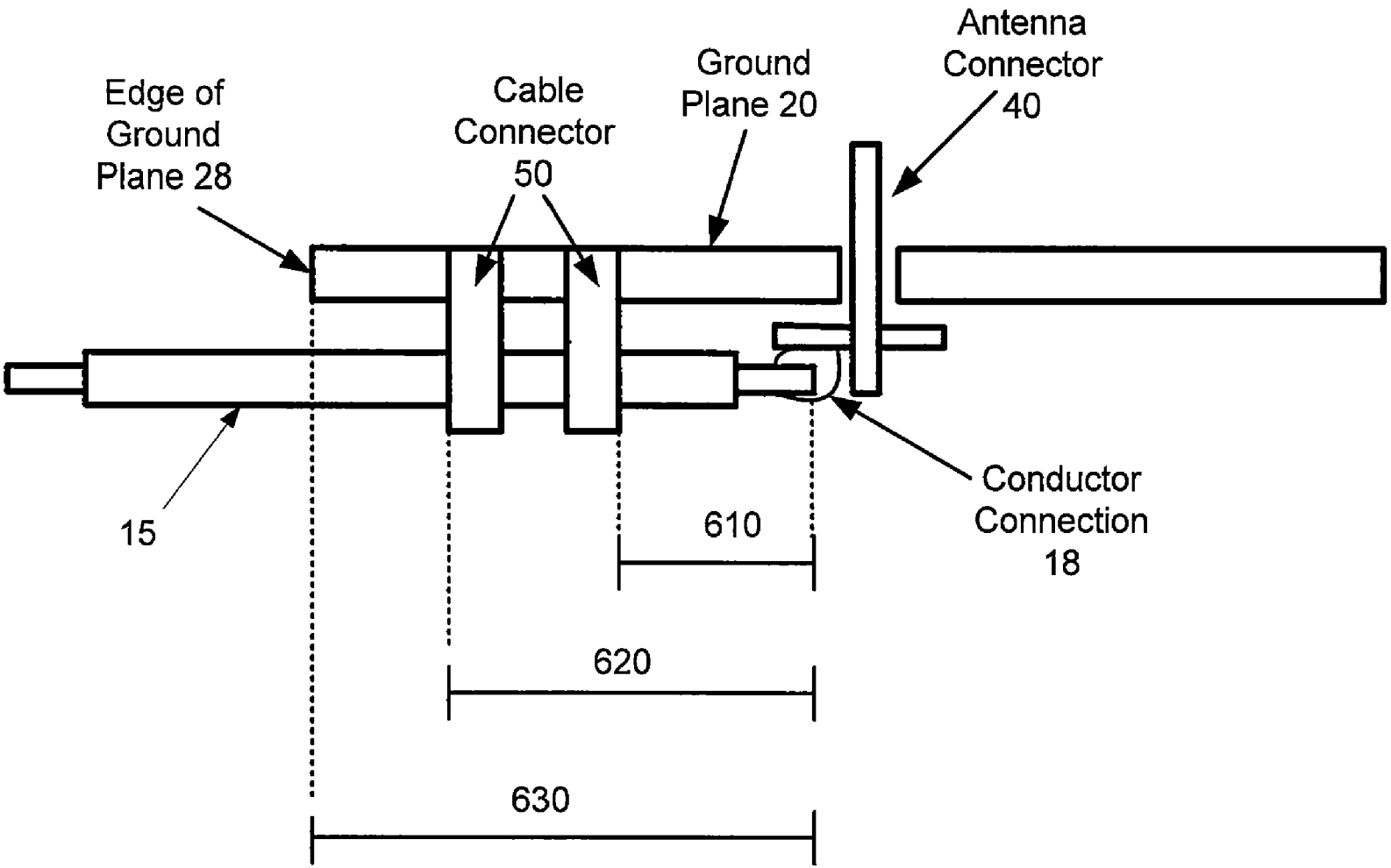
FIG. 8 illustrates a side view of one embodiment of an antenna system.

The feed cable 15 and the conductor tab 44 may be connected. The feed cable 15 may extend parallel to or substantially parallel to the ground plane 20. The feed cable 15 may be parallel to or substantially parallel to the ground plane 20 over a distance from the conductor connection 18 (or, alternatively, an edge of the inner conductor 16) to the cable connector 50, which is illustrated in FIG. 8 as distance 610. In another example, the feed cable 15 may be parallel to or substantially parallel to the ground plane 20 over a distance from the conductor connection 18 (or, alternatively, an edge of the inner conductor 16) through the cable connector 50, which is illustrated in FIG. 8 as distance 620. In yet another example, the feed cable 15 may be parallel to or substantially parallel to the ground plane 20 over a distance from the conductor connection 18 (or, alternatively, an edge of the inner conductor 16) to at least an edge 28 of the ground plane 20, which is illustrated in FIG. 8 as distance 630. As used herein, the phrase "substantially parallel to the ground plane" may include disposed such that all, some, or no portions are perpendicular or substantially perpendicular to the ground plane. All or a portion of the feed cable 15 may not extend in a direction that is perpendicular to the ground plane 20 while above, below, or around the ground plane 20.

One benefit of connecting the inner conductor 16 to a conductor tab 44 that extends toward an edge 28 of the ground plane 20 is that a side-exiting feed cable 15 may be used to feed the antenna 30. As used herein, a side-exiting feed cable is a feed cable 15 that runs parallel to the ground plane 20, at least while adjacent to the ground plane 20. Accordingly, the feed cable 15 does not need to be curved or turned (e.g., using the minimum turn radius) to extend beyond an edge 28 of the ground plane 20.

In one embodiment, the feed probe 42 and conductor tab 44 are integrated with each other. For example, the feed probe 42 and conductor tab 44 may be manufactured, molded, or connected as a single component.

The feed probe 42 and conductor tab 44 may be made of or plated with brass or another metal that is compatible with the antenna 30 and inner conductor 16 of the feed cable 15.

As shown in FIG. 1 and FIG. 6, the antenna system 100 may include a first spacer 26*a* that insulates the antenna 30 from the ground plane 20 and a second spacer 26*b* that insulates the antenna connector 40 and/or inner conductor 16 from the ground plane 20. In one embodiment, the first spacer 26*a* and second spacer 26*b* are nylon shoulder washers or other non-conducting washers. As shown in FIG. 6, the feed probe 42 may extend through an opening in the first and second spacers 26*a*, 26*b*. Alternatively, a single spacer may be used one either side.

One benefit of using a metal tab as the conductor tab 44, a screw as the feed probe 42, and/or nylon shoulder washers as the first and second spacers 26 is that off the shelf parts may be used to electrically couple the feed cable 15 with the antenna 30 and insulate the ground plane 20. The cost of obtaining a screw, a metal tab, and non-conducting washers is relatively inexpensive compared to a complex connection system that requires one or more clamping devices or crimp sleeves, which require special manufacturing.

The metal tab may be mechanically fixed to the feed probe 42. For example, the metal tab and feed probe 42 may be manufactured as a single unit. In another example, the metal tab may be soldered to the feed probe 42. As used herein, mechanically fixed to includes structurally united with, fixed without movement to, or bonded to.

Figure 9:
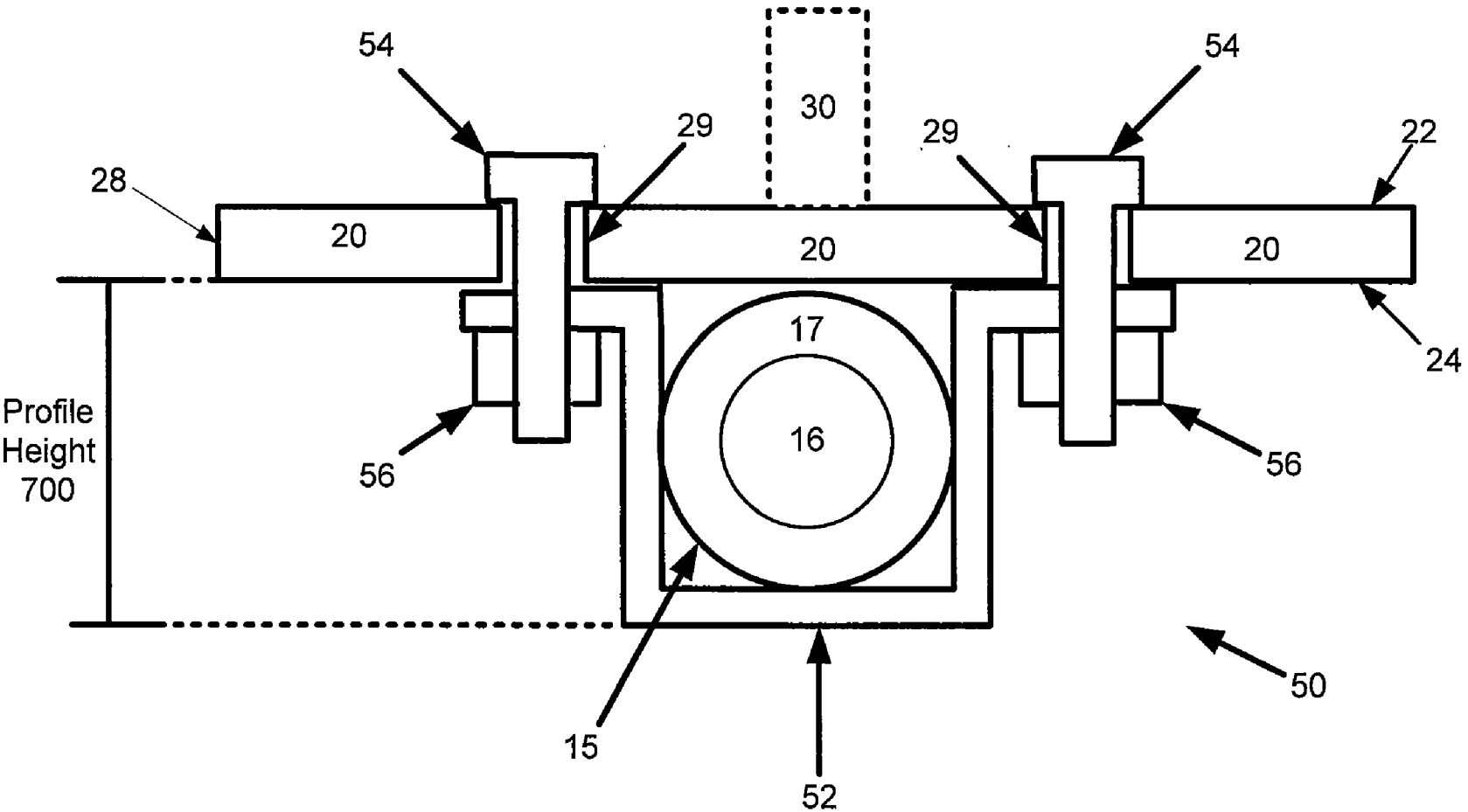
FIG. 9 illustrates a cross-sectional view of one embodiment of an antenna system.

FIG. 9 shows one embodiment of a cable connector 50 that couples the feed cable 15 with the ground plane 20. The cable connector 50 may be a cable assembly or cable clamp. The cable connector 50 may include one or more brackets 52 that extend around a diameter of the feed cable 15 and are coupled to the ground plane 20. The feed cable 15 is coupled to the ground plane 20. The one or more brackets 52 may be coupled to the ground plane 20 using one or more screws or bolts 54 that engage the bracket 52. The screws 54 may be inserted through openings 29 in the ground plane 20 and openings in the bracket 52. One or more nuts 56 may be attached to an end of the one or more screws 54. The nuts 56 may be used to couple the bracket with the ground plane 20. The nuts 56 may be integrated with or provided as part of the bracket 52. Since the outer insulation layer 17 is disposed between the inner conductor 16 and the bracket 52, the cable connector 50 and the ground plane 20 are electrically isolated from the inner conductor 16.

One benefit of using a bracket 52, one or more screws 54, and/or one or more nuts 56 is that off the shelf parts may be used to couple the feed cable 15 with the ground plane 20. The cost of obtaining a bracket 52, one or more screws 54, and one or more nuts 56 is relatively inexpensive compared to a complex connection system that requires one or more clamping devices or crimp sleeves that require special manufacturing. Additionally, the cable connector 50 allows the feed cable to extend parallel to the ground plane 20 and prevents the inner conductor 16, disposed between the cable connector 50 and the conductor tab 44, from being moved. Accordingly, the conductor connection 18 will experience little or no force, and thus, disconnect between the inner conductor 16 and the conductor tab 44 may be prevented.

Figure 10:
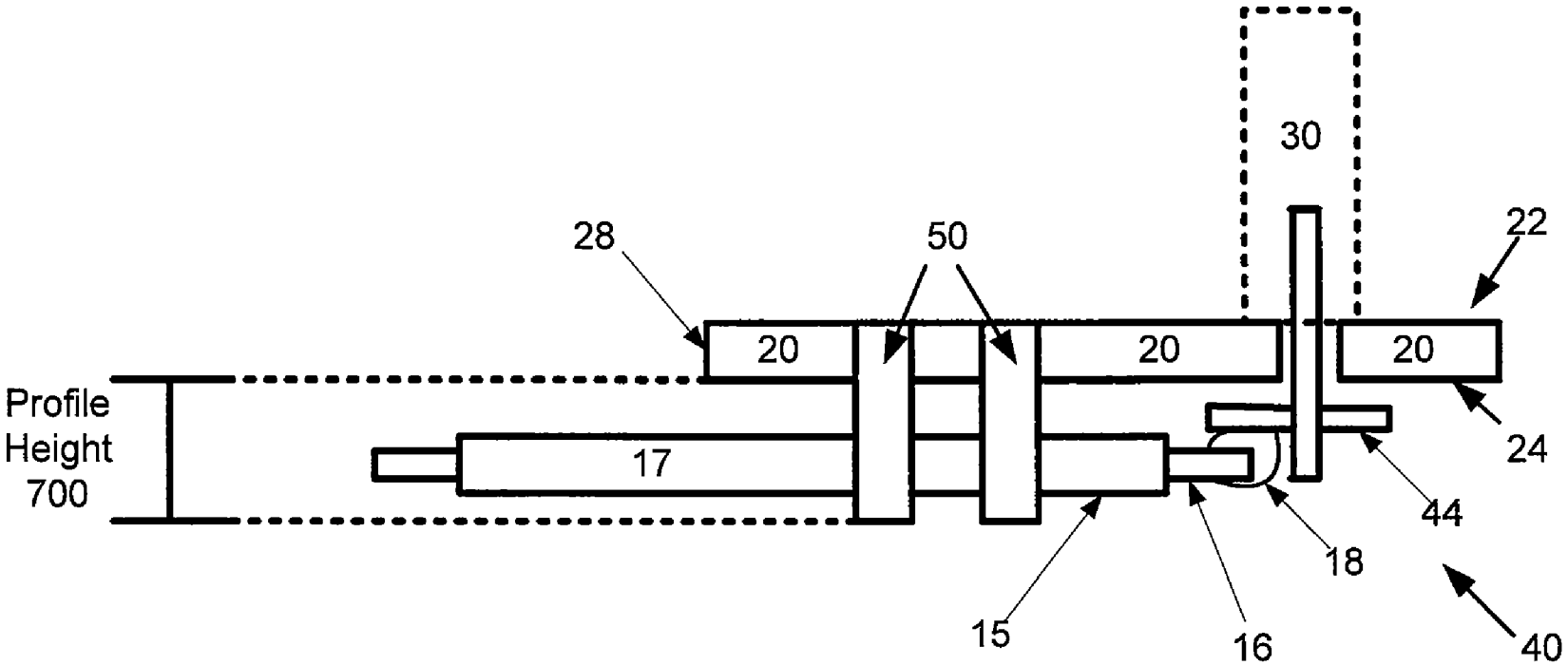
FIG. 10 illustrates a side view of one embodiment of an antenna system.

FIGS. 9 and 10 illustrate a profile height 700 of the antenna system 100. FIG. 9 illustrates a cross-sectional view of the cable connector 50 and FIG. 10 illustrates a side view of the cable connector 50. As used herein, the profile height 700 may be a distance from the ground plane 20 to a point on the feed cable 15, a point on the antenna connector 40, and/or a point on the cable connector 50 that furthest from the ground plane 20 on the second ground side 24. The point furthest from the ground plane 20 may include the point that is furthest from the ground plane 20 under or above the ground plane 20. In other words, the point does not extend beyond the edge 28 of the ground plane 20. As shown in FIGS. 9 and 10, the profile height 700 may be from the ground plane 20 to a point on the bracket 52 that is furthest from the ground plane 20 on the second ground side 24. However, in other embodiments, the profile height may be to a point on the feed cable 15 or on the antenna connector 40.

Since the feed cable 15 may extend in a direction parallel to the ground plane 20, the antenna system 100 may have a low profile height 700. The profile height 700 of the antenna system 100 may be in the range of a tenth of an inch to ten inches. For example, the profile height 500 may be less than a one half inch, less than one inch, less than three inches, or less than ten inches. In alternative embodiments, the profile height 700 may be greater than ten inches or less than a tenth of an inch.

Figure 11:
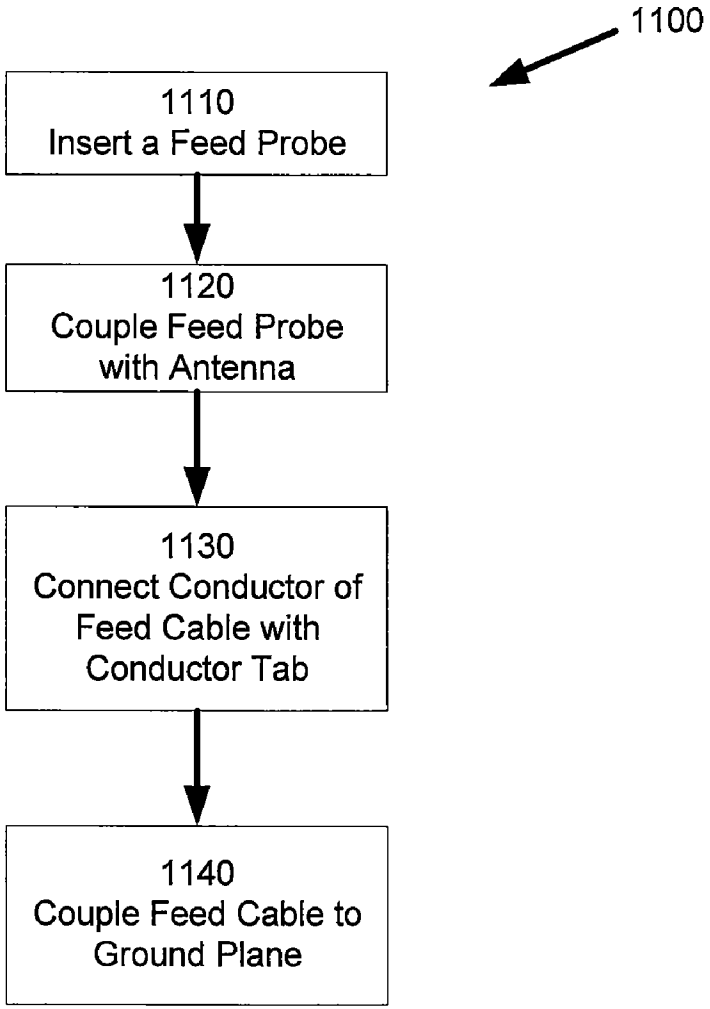
FIG. 11 illustrates a flow chart of one embodiment of a method for electrically coupling an antenna to a feed cable.

FIG. 11 shows a flow chart of one embodiment of a method 1100 for electrically coupling an antenna to a feed cable. The method is implemented using the system 100 of FIG. 1, one or more of the structures of FIGS. 2-10, or a different system or structure. The acts may be performed in the order shown or a different order. The acts may be performed automatically, manually, or the combination thereof.

The method 1100 may include inserting a feed probe, as illustrated in block 1110. For example, the feed probe is inserted through an opening in a conductor tab, through an opening in a first non-conductive spacer, through an opening in a ground plane, through an opening in a second non-conductive spacer, and into a support opening in the antenna. The feed probe may be inserted through components in that order or a different order. The feed probe is inserted through the opening in the conductor tab and the feed probe is electrically coupled with the conductor tab.

As shown in block 1120, the feed probe may be mechanically and electrically coupled with the antenna, for example, by screwing the feed probe into the opening in the antenna or by embedding in conductive paste. Once the feed probe is coupled with the antenna, the feed probe may structurally and/or mechanically support the antenna.

A conductor of a feed cable may be connected, for example, with solder, to the conductive tab. The conductor of the feed cable is electrically coupled with conductive tab and the feed probe, as shown in block 1130.

A portion of the feed cable may be coupled to the ground plane by attaching a cable connector, as shown in block 1140. Attaching a cable connector may include inserting one or more screws through one or more openings in the ground plane, through one or more openings in a bracket that extends around all or a portion of the diameter of the feed cable, and attaching one or more nuts to the one or more screws.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. An antenna connector comprising:

a feed probe to extend through a ground plane and into an antenna; and a metal tab configured to be coupled with the feed probe, the metal tab to extend from the feed probe in a direction substantially parallel to the ground plane, the metal tab being configured to directly couple a feed cable with the feed probe, the feed cable arranged to extend substantially perpendicular to the feed probe.

2. The connector as claimed in claim 1, further comprising a spacer disposed between the metal tab and the ground plane, the spacer electrically isolating the metal tab and the ground plane.

3. The connector as claimed in claim 2, wherein the feed probe and the metal tab are made of brass, and wherein the spacer is a nylon washer.

4. The connector as claimed in claim 1, where the feed probe is configured to provide mechanical support to the antenna.

5. The antenna connector of claim 1, wherein the feed probe comprises a fastener configured to extend through the ground plane and engage the antenna.

6. An antenna connector comprising:

a feed probe to extend through a ground plane and into an antenna; and a metal tab configured to be coupled with the feed probe, the metal tab to extend from the feed probe in a direction substantially parallel to the ground plane, the metal tab being configured to electrically couple a feed cable with the feed probe, the feed cable arranged to extend substantially perpendicular to the feed probe, wherein the feed probe is a screw having a screw head, a screw shaft, and a threading pattern, the screw shaft configured to extend through the ground plane and the threading pattern configured to be threaded into the antenna.

7. The connector as claimed in claim 6, wherein the metal tab is a solder tab that is configured to be soldered to a conductor of the feed cable.

8. The connector as claimed in claim 7, wherein the feed cable is a coaxial cable.

9. The connector as claimed in claim 6, wherein the metal tab is fixed to the feed probe.

10. The connector as claimed in claim 6, wherein the metal tab is disposed between the screw head and a spacer that electrically isolates the ground plane and the metal tab.

11. A method for attaching an antenna to a feed cable, the method comprising:

inserting a feed probe through an opening in a ground plane and into a cavity in the antenna;

electrically coupling the feed probe with the antenna; and coupling a conductor of the feed cable with a metal tab using a conduction connector, the metal tab configured to be electrically coupled with the feed probe, the feed cable arranged to extend substantially parallel to the ground plane when the conductor of the feed cable is directly coupled with the metal tab.

12. The method of claim 11, wherein the feed probe is a screw having a screw head, a screw shaft, and a threading pattern and wherein electrically coupling the feed probe with the antenna comprises threading the threading pattern into the antenna.

13. The method of claim 11, wherein the feed probe comprises a fastener and wherein electrically coupling the feed probe with the antenna comprises engaging the fastener into the antenna.

14. An apparatus comprising:

a ground plane having a first ground side and a second ground side;

an antenna disposed on the first ground side of the ground plane;

a feed cable having a conductor operable to feed the antenna;

a cable connector that couples the feed cable with the second ground side; and an antenna connector that electrically couples the conductor with the antenna, the antenna connector comprising:

a feed probe to extend through the ground plane and into an antenna; and a metal tab configured to be coupled with the feed probe, the metal tab to extend from the feed probe in a direction substantially parallel to the ground plane, the metal tab being configured to electrically couple the feed cable with the feed probe, the feed cable arranged to extend substantially perpendicular to the feed probe, wherein the feed cable is arranged substantially parallel to the ground plane from the antenna connector to the cable connector.

15. The apparatus of claim 14, wherein the feed probe is a screw configured to extend through an opening in the ground plane to support the antenna, the feed probe being electrically insulated from the ground plane.

16. The apparatus of claim 14, wherein the feed cable is arranged to extend parallel to the ground plane from the antenna connector to an edge of the ground plane.

17. The apparatus of claim 14, wherein the metal tab is sized to be soldered to the conductor.

18. The apparatus of claim 14, further comprising:

a first spacer that insulates the antenna from the ground plane; and a second spacer that insulates the antenna connector from the ground plane.

19. The apparatus of claim 18, wherein the first spacer and the second spacer are nylon shoulder washers.

20. The apparatus of claim 14, wherein the antenna and the antenna connector comprise brass.

21. The apparatus of claim 14, wherein the cable connector comprises a bracket that extends around a diameter of the feed cable and is coupled to the ground plane, the feed cable being coupled to the ground plane.

22. The apparatus of claim 14, wherein the feed cable is a coaxial cable that includes an insulation layer that insulates the conductor from the bracket and the ground plane.

* * * * *

UNITED STATES PATENT AND TRADEMARK OFFICE

CERTIFICATE OF CORRECTION

PATENT NO. : 8,242,969 B2
APPLICATION NO. : 12/437936
DATED : August 14, 2012
INVENTOR(S) : Thomas Goss Lutman et al.

It is certified that error appears in the above-identified patent and that said Letters Patent is hereby corrected as shown below:

In the Claims

In column 8, claim 3, line 20, after "as claimed in claim" replace "2" with --1--.

Signed and Sealed this
Twenty-fifth Day of December, 2012

David J. Kappos

David J. Kappos
*Director of the United States Patent and Trademark Office*